US010815578B2

(12) United States Patent
DiFranco

(10) Patent No.: US 10,815,578 B2
(45) Date of Patent: Oct. 27, 2020

(54) CATALYZED CUSHION LAYER IN A MULTI-LAYER ELECTRODE

(71) Applicant: Dino DiFranco, Mayfield Village, OH (US)

(72) Inventor: Dino DiFranco, Mayfield Village, OH (US)

(73) Assignee: Electrode Solutions, LLC, Mayfield Village, OH (US)

( * ) Notice: Subject to any disclaimer, the term of this patent is extended or adjusted under 35 U.S.C. 154(b) by 0 days.

(21) Appl. No.: 15/699,092

(22) Filed: Sep. 8, 2017

(65) Prior Publication Data

US 2019/0078219 A1 Mar. 14, 2019

(51) Int. Cl.

| | |
|---|---|
| ***C25B 11/04*** | (2006.01) |
| ***C25B 11/03*** | (2006.01) |
| ***C25B 1/46*** | (2006.01) |
| ***C25D 21/12*** | (2006.01) |
| ***C25D 3/02*** | (2006.01) |
| ***C25D 5/40*** | (2006.01) |
| *C25D 3/12* | (2006.01) |
| *C25D 3/50* | (2006.01) |
| *C25D 3/46* | (2006.01) |
| *C25D 3/48* | (2006.01) |

(52) U.S. Cl.

CPC ..... *C25B 11/0405* (2013.01); *C25B 1/46* (2013.01); *C25B 11/03* (2013.01); *C25B 11/0415* (2013.01); *C25B 11/0447* (2013.01); *C25D 3/02* (2013.01); *C25D 5/40* (2013.01); *C25D 21/12* (2013.01); *C25D 3/12* (2013.01); *C25D 3/46* (2013.01); *C25D 3/48* (2013.01); *C25D 3/50* (2013.01)

(58) Field of Classification Search

CPC .. C25B 1/34; C25B 1/46; C25B 11/00; C25B 11/02; C25B 11/04; C25B 11/0405; C25B 9/02; C25B 9/06–9/066; C25B 13/02; H01M 8/00–8/10; H01M 8/1004–8/16; H01M 8/18–8/24

See application file for complete search history.

(56) References Cited

U.S. PATENT DOCUMENTS 4,111,779 A 9/1978 Seko et al.
4,242,184 A 12/1980 Ford
(Continued)

FOREIGN PATENT DOCUMENTS

EP 1487747 B1 12/2004
EP 2039806 A1 3/2009
(Continued)

OTHER PUBLICATIONS

Toulhoat, Hervé & Raybaud, Pascal & Mendez, Violaine & Puzenat, Eric. (2018). A universal relationship predicts optimal catalysts for a given chemical reaction. https://www.researchgate.net/publication/329947052_A_universal_relationship_predicts_optimal_catalysts_for_a_given_chemical_reaction.

(Continued)

*Primary Examiner* — Alexander W Keeling
(74) *Attorney, Agent, or Firm* — Dominic A. Frisina

(57) ABSTRACT

A zero-gap electrode is taught herein having a non-platinum containing catalytic coating that can be applied ex situ or in situ and that significantly reduces hydrogen overpotential. Moreover, the electrode taught herein includes a catalyzed fine mesh layer, cushion layer, and rigid backing.

19 Claims, 5 Drawing Sheets

(56) References Cited

U.S. PATENT DOCUMENTS

| | | | | |
|---|---|---|---|---|
| 4,444,632 | A | 4/1984 | deNora | |
| 4,687,558 | A | 8/1987 | Justice et al. | |
| 4,693,797 | A * | 9/1987 | deNora | C25B 1/46 204/252 |
| 5,227,030 | A | 7/1993 | Beaver et al. | |
| 5,599,430 | A * | 2/1997 | Pimlott | C25B 9/04 204/252 |
| 5,715,935 | A | 2/1998 | Seki | |
| 6,051,117 | A | 4/2000 | Novak et al. | |
| 8,313,623 | B2 * | 11/2012 | Antozzi | C25B 1/34 204/290.1 |
| 9,255,334 | B2 | 2/2016 | Subbaraman et al. | |
| 9,273,403 | B2 | 3/2016 | Bulan et al. | |
| 9,404,191 | B2 | 8/2016 | Hara et al. | |
| 9,476,130 | B2 | 10/2016 | Suemoto et al. | |
| 2004/0188245 | A1 | 9/2004 | Katayama et al. | |
| 2009/0301871 | A1 | 12/2009 | Zappi et al. | |
| 2012/0241314 | A1 * | 9/2012 | Madono | C25B 11/035 204/252 |
| 2013/0299342 | A1 * | 11/2013 | Suemoto | C25B 11/03 204/252 |
| 2015/0122641 | A1 * | 5/2015 | Kodama | C25B 15/04 204/297.14 |
| 2015/0203976 | A1 * | 7/2015 | Noaki | C25B 9/20 204/256 |

FOREIGN PATENT DOCUMENTS

| | | | |
|---|---|---|---|
| WO | 2002027846 | A1 | 4/2002 |
| WO | 2014082843 | A1 | 6/2014 |

OTHER PUBLICATIONS

Sapountzi, F.M. & Gracia, Jose & Weststrate, C. & Fredriksson, Hans & Niemantsverdriet, Hans. (2017). Electrocatalysts for the generation of hydrogen, oxygen and synthesis gas. Progress in Energy and Combustion Science. 58. 1-35. https://doi.org/10.1016/j.pecs.2016.09.001.

Catalyzed Cushion Layer in Multi-Layer Electrode, PCT/US2018/058632, Apr. 8, 2019, International Search Report.

* cited by examiner

CATALYZED CUSHION LAYER IN A MULTI-LAYER ELECTRODE

I. BACKGROUND OF THE INVENTION

A. Field of Invention

Embodiments of the invention generally relate to the field of electrochemical electrodes.

B. Description of the Related Art

There is constant economic pressure to lower the energy requirements of industrial-scale electrochemical processes, as power consumption costs weigh heavily on profitability. Generally, power consumption can be decreased in at least two broadly-defined ways. One is to decrease the distance between the cathode and anode, and another is through heterogeneous catalysis at the electrode surface. The historical development of the chlor-alkali process is illustrative of how these two approaches can cooperate to reduce power consumption.

Briefly, the chlor-alkali process is the production of chlorine and caustic soda via the electrolysis of brine solutions, and has been practiced commercially since the end of the nineteenth century. The process involves feeding DC power to a cell wherein brine, i.e. aqueous NaCl or KCl solution, is electrolyzed according to Equation 1.

$$2NaCl + 2H_2O \rightarrow \underbrace{Cl_2}_{(anode)} + \underbrace{H_2 + 2NaOH}_{(cathode)} \qquad \text{(Equation 1)}$$

Chlorine is produced at the anode when the chloride ion donates an electron to the anode forming elemental chlorine, which then combines with another chlorine atom forming molecular chlorine. Under typical operating conditions, the chlorine readily nucleates forming chlorine gas bubbles that may be collected. Hydrogen is produced at the cathode by splitting water into a proton and a hydroxide ion. The proton is reduced by the cathode to elemental hydrogen. Elemental hydrogen then combines with another hydrogen atom forming molecular hydrogen which may be similarly collected. The hydroxide ion combines either with a sodium ion forming caustic soda (NaOH), or with a potassium ion forming caustic potash (KOH) depending on whether NaCl or KCl is the anolyte.

An early production method dating to the late 1800s, known as the Castner-Kellner process, utilized mercury cells. Castner-Kellner cells traditionally included graphite anodes and liquid mercury cathodes with brine solution flowing over the cathode. As chloride is reduced to chlorine at the anode, sodium ion amalgamates with the mercury cathode where it is reduced to sodium metal. Castner-Kellner cell processes do not use a barrier to separate the anode and cathode, so a predetermined distance of separation between the electrodes is necessary to prevent the anodic and cathodic reactions from interfering with each other. Although this method is still in use today, it has relatively high power requirements, and its use of mercury makes it a health and environmental risk. To a limited extent the power requirements have been mitigated by switching to catalyzed titanium anodes.

In the twentieth century, chlorine production using a diaphragm cell process gained prominence. Interposing a diaphragm between the anode and cathode segregates the $Cl_2$ anodic reaction product from the caustic soda cathodic reaction product while allowing brine solution to flow through from the anode compartment to the cathode compartment. This permits a significant reduction in the required distance between the anode and cathode. Thus, diaphragm processes consume less energy than Castner-Kellner processes, and the health and environmental hazards of using mercury are eliminated. Diaphragm cell anodes are most often catalytically activated titanium and the cathode is often steel. The diaphragm can be an asbestos or Teflon based material and is often deposited directly on the cathode or placed in direct contact with the cathode. To protect the catalytic coating on the titanium and to preserve cell efficiency, the anode is often stood off from the diaphragm by a fixed distance. Thus diaphragm processes reduce power requirements through a combination of electrode gap reduction, anodic and cathodic reaction product segregation, and catalytic anode coatings.

In the 1970's, the membrane cell process was commercialized and utilized a cation permeable ion exchange membrane in place of a non-selective diaphragm. Membranes permit sodium or potassium cations to pass between the anode and cathode compartments, but does not permit the much larger chloride and hydroxide anions through. Thus, membrane cells maintain complete separation of chlorine and caustic soda products while also keeping the cathode compartment free from salt deposits.

Membrane cell anodes are often catalytically activated titanium and the cathode is either nickel or catalytically activated nickel. The electrodes are typically constructed from metal mesh, perforated metal plate, louvered metal or a similar structure that allows the diffusion of gas products and liquid electrolyte while still providing a conductive surface for electrolysis. Early membrane cells were constructed with the membrane either very close to the anode or in direct contact with it, but with a fixed gap between the membrane and the cathode. Keeping the membrane physically separate from the cathode avoided damage to the membrane such as through pinching, creasing, or perforating. Accordingly, these cells are referred to as "finite gap" cells. Examples of membrane chlor-alkali cells are found in U.S. Pat. Nos. 4,111,779 and 4,242,184.

More recent membrane cell designs have minimized the gap between the anode and cathode to further reduce energy consumption. These cells are referred to as "zero gap" cells. Zero gap cells typically have a three-part cathode including a rigid backing, a resilient middle cushion layer, and fine mesh layer that physically contacts the ion exchange membrane. The cushion layer is elastically compressible and thus serves as a spring pushing the fine mesh layer against the ion exchange membrane.

U.S. Pat. No. 4,444,632 A discloses a cathode that includes a cushion layer and a fine mesh layer, where the cushion layer is used to push the fine mesh layer against the membrane and thus reduce the electrode gap without damaging the membrane. U.S. Pat. No. 4,693,797 discloses the use of a fine mesh pushed against the membrane by a resilient compressible mat wherein the fine screen can also be catalyzed. Patent US 2013/0299342 A1 discloses a compressible layer made by winding a wire around a metal frame. U.S. Pat. No. 5,599,430 A discloses a compressible layer made up of multiple sublayers, and patent EP 2,039,806 B1 discloses retrofitting existing membrane cells with a compressible layer. U.S. Pat. No. 9,476,130 B2 and U.S. Pat. No. 4,687,558 A and US 2013/0299342 A1 discuss utilizing a catalyzed fine mesh adjacent to the membrane and backed by a compressible mat. Thus it is well-known in the art to construct a zero-gap membrane cell wherein a compressible layer pushes a fine mesh layer of a cathode against the membrane.

It is also generally known to use catalytic coatings to, for instance, lower the overpotential of the hydrogen electrolysis reaction. Moreover, it is believed in the art that the hydrogen electrolysis reaction occurs principally on the fine mesh layer of the cathode, i.e. directly adjacent to the ion exchange membrane. It is commonly understood in the art that other cathodic surfaces have negligible electrolytic activity. Accordingly, the fine electrode is often catalyzed, while the cushion layer is not.

Generally, catalytic coatings may be applied either in situ or ex situ. For instance, the fine mesh layer can be removed from the cell and coated ex situ, thereby isolating the coating to that specific part, or a catalyst solution can be applied in situ, e.g. under the cell's operating conditions. In the latter case the catalyst coats all cathodically active surfaces. Known catalysts that can be applied in situ are platinum, and platinum alloyed with certain amounts of other platinum group metals. It is generally understood in the art that platinum is the only viable matrix metal for in situ coating due to the chemical operating conditions of chlor-alkali membrane cells. While platinum is costly, it is also costly to shut down an electrolyzer to coat an electrode ex situ. Thus, in many cases it is advantageous to coat in situ.

What is missing in the art is in situ catalytic coatings having a non-platinum matrix metal, particularly those which are applied to surfaces other than the fine mesh layer of the cathode. Some embodiments of the present invention may provide one or more benefits or advantages over the prior art.

II. SUMMARY OF THE INVENTION

Some embodiments may relate to a zero-gap electrode assembly, which may comprise a fine mesh being flexible and electrically conductive. The fine mesh may have a catalytic coating consisting essentially of one or more of cobalt, gold, iridium, osmium, palladium, rhenium, rhodium, ruthenium, or silver. The zero-gap electrode assembly may also have one or more cushion layers in electrical communication with the fine mesh. The cushion layer may have a catalytic coating consisting essentially of one or more of cobalt, gold, iridium, osmium, palladium, rhenium, rhodium, ruthenium, or silver. The assembly may also have a rigid backing, being electrically conductive and in electrical communication with the cushion layer.

The flexible fine electrically conductive mesh may comprise woven nickel wire mat having a wire diameter between 0.05 mm and 0.50 mm+/−10%, and a weave density between 20 strands per inch and 60 strands per inch+/−10%.

The flexible fine electrically conductive mesh may have a thickness between 0.05 mm and 0.50 mm+/−10%, and comprises woven nickel wire mat, welded nickel wire mat, expanded nickel, louvered nickel, or a punched porous nickel plate.

The cushion layer may have a catalytic coating between 0.005 μm and 5 μm thick.

The cushion layer may comprise a catalyst layer thickness greater than 5 μm.

The cushion layer may have a catalytic coating between 5 $mmol/m^2$ and 120 $mmol/m^2$.

An interface between a cushion layer substrate and the catalytic coating may be substantially free from added roughness.

The fine mesh may be in electrically communicative physical contact with a cathode side of an ion-exchange membrane. Furthermore, the assembly may be in electrochemical communication with a catholyte solution which may comprise caustic soda.

An assembly according to some embodiments may have a cathodic voltage that is 30 mV to 400 mV less than a voltage of the assembly without the catalyst layer.

An assembly according to some embodiments may have a cathodic voltage that is 20% to 50% less than a voltage of the assembly without the catalyst layer.

According to some embodiments the fine mesh may be in electrically communicative physical contact with an anode side of an ion-exchange membrane.

An assembly according to some embodiments may be in electrochemical communication with an anolyte solution.

In some embodiments the rigid backing may comprise a catalytic coating consisting essentially of one or more of cobalt, gold, iridium, osmium, palladium, rhenium, rhodium, ruthenium, or silver.

In some embodiments the catalytic coating of the fine mesh and/or the cushion layer further comprises one or more additive elements selected from copper, lanthanum, praseodymium, molybdenum, cerium, tantalum, titanium, molybdenum, manganese, tungsten, vanadium, indium, tin, nickel, chromium, zinc and carbon.

In some embodiments each of the one or more additive elements is present in an amount between 0.00001% and 50.0 at. %, wherein the sum of all additive elements does not exceed 50.0 at. %.

In some embodiments the catalytic coating of the rigid backing further comprises one or more additive elements selected from copper, lanthanum, praseodymium, molybdenum, cerium, tantalum, titanium, molybdenum, manganese, tungsten, vanadium, indium, tin, nickel, chromium, zinc and carbon.

In some embodiments each of the one or more additive elements is present in an amount between 0.00001% and 50.0 at. %, wherein the sum of all additive elements does not exceed 50.0 at. %.

Embodiments of the invention may include a method of catalyzing a zero-gap electrode assembly comprising the following steps, not necessarily in the order presented. The method may include submerging a zero-gap electrode assembly in an aqueous electrolyte solution comprising concentrated NaOH or KOH having a normality between 1N and 14N, wherein all surfaces of the zero-gap electrode to be catalyzed contact the electrolyte solution. It may further include providing an external circuit in electrical communication with the zero-gap electrode. The method may further include applying a negative potential to the zero-gap electrode through the external circuit sufficient to cause a current density between 1 kA/m2 and 10 kA/m2+/−10%. Another step can include adding an effective amount of catalyst precursor to the aqueous electrolyte solution, the catalyst precursor being selected from one or more of tetramine (chloroaqua) cobalt (III), tetramine dichloro cobalt (III), cobalt(II) hydroxide, gold(III) hydroxide, gold tetraamine complexes, tetraamineiridium chloride, iridium (IV) hydroxide, tetraaminedioxoosmium (VI) chloride, osmium (IV) hydroxide, palladium (II) hydroxide, and tetraamminepalladium (II) chloride monohydrate, tetraaminepalladium (II) hydroxide, tetraaminepalladium (II) tetrachloropalladate (II), tetraaminepalladium (II) oxalate tetraaminepalladium (II) bromide, sodium perrhenate (VII), potassium perrhenate (VII), rhodium (III) hydroxide, tetraaminediaquarhodium (III) complexes, ruthenium tetraamine and complexes, potassium ruthenate (VI), sodium ruthenate (VI), silver(I) perrhenate, and silver(I) hydroxide. Finally, the method may include maintaining the negative potential at least until between 10 and 50 mmol/m2+/−10% of one or more catalyst metals deposit onto the zero-gap electrode surface.

Definitions

As used herein the terms "embodiment", "embodiments", "some embodiments", "other embodiments" and so on are not exclusive of one another. Except where there is an explicit statement to the contrary, all descriptions of the features and elements of the various embodiments disclosed herein may be combined in all operable combinations thereof.

Language used herein to describe process steps may include words such as "then" which suggest an order of operations; however, one skilled in the art will appreciate that the use of such terms is often a matter of convenience and does not necessarily limit the process being described to a particular order of steps.

Conjunctions and combinations of conjunctions (e.g. "and/or") are used herein when reciting elements and characteristics of embodiments; however, unless specifically stated to the contrary or required by context, "and", "or" and "and/or" are interchangeable and do not necessarily require every element of a list or only one element of a list to the exclusion of others.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof, wherein like reference numerals indicate like structure, and wherein.

IV. DETAILED DESCRIPTION OF THE INVENTION

Embodiments of the invention relate to non-platinum catalytic electrode coatings and related methods of making and using such coatings. Embodiments may also relate to electrochemical anodes and cathodes that include non-platinum catalytic electrode coatings, particularly zero-gap electrodes having a non-platinum catalyzed cushion layer.

While in the past cushion layers were sometimes catalyzed by default in in situ coating processes, until now cushion layers were not specifically targeted because it was conventionally believed that they had negligible participation in the electrolytic reaction. This was a self-fulfilling prophesy because, operating under this mistaken belief, cells were manufactured with un-catalyzed cushion layers. Thus, the cushion layer did exhibit negligible activity, but this was due primarily to its lack of catalytic coating, and only to a much lesser degree due to it distance from the membrane. The teachings of the present invention indicate that conventional wisdom is wrong, that cushion layers have significant electrolytic activity when catalyzed, and that platinum-matrix catalytic layers can be replaced by non-platinum alternatives.

Methods are taught herein for applying non-platinum catalyst in situ to a cushion layer as well as to other cathode components, thereby significantly increasing the electrolytically active area and lowering the cell voltage. Chlor-alkali cells are used herein as examples; however, the ordinarily skilled artisan will readily appreciate that the disclosed coatings are suitable for many other types of electrolytic cells.

Figure 1:
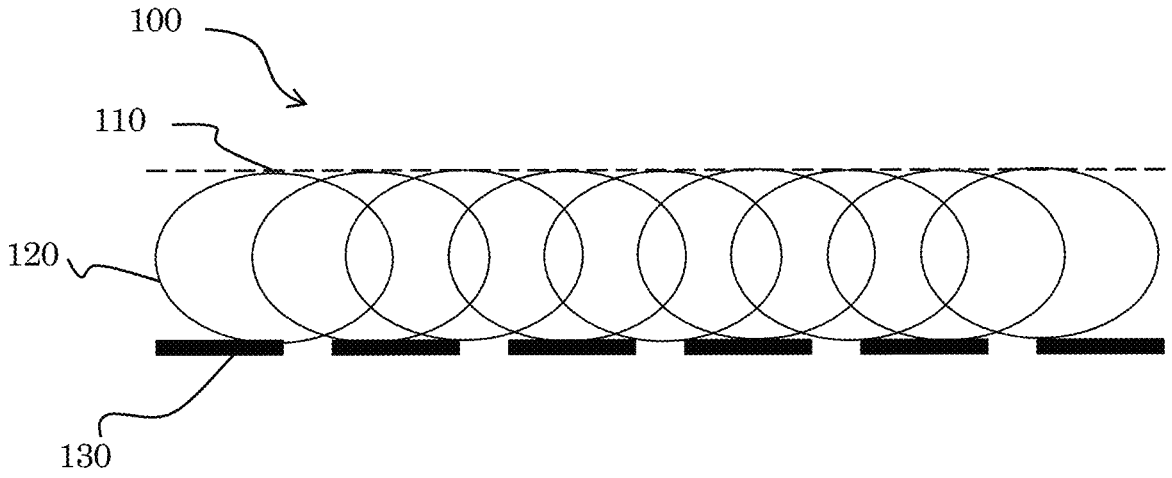
FIG. 1 is a side view of a typical zero-gap electrode.

An electrode according to some embodiments of the invention can comprise a structure as illustrated in FIG. 1. According to FIG. 1, a zero-gap electrode 100 may include a rigid backing 130, a central cushion layer 120, and a fine mesh layer 110. While only a single layer of cushion material is illustrated in FIG. 1, the skilled artisan will appreciate that multilayers are also within the scope of the invention. The rigid backing 130 may be adapted to electrically communicate with an external circuit. For instance, the backing may include a terminal or other known structure suitable for this purpose, which the skilled artisan would readily appreciate as a matter of design choice. The cushion layer 120 may be spot welded to the rigid backing 130 and to the fine mesh 110, according to methods known in the art, thereby forming a unitary structure with operably sufficient electrical conductivity. The skilled artisan will appreciate that the invention is not limited to methods of joining the backing 130, cushion layer 120, and fine mesh 110 and that other suitable means known in the art may be substituted without departing from the scope of the invention. Moreover, while the specific structure of the fine mesh 110 may vary as set forth in detail herein, suitable structures are capable of physically contacting an ion exchange membrane without damaging the membrane. Thus, suitable fine meshes are substantially free of sharp edges and points that may perforate a membrane. Advantageously, catalytic material may be applied to the cathode components, including the cushion layer. The term "catalytic material" is used here to indicate that catalyst may take the form of metals, metal oxides, or mixtures thereof.

Fine mesh according to some embodiments of the invention can include an electrically conductive mesh comprising a woven nickel wire mat. Not intending to indicate order of preference, the fine mesh may alternatively comprise a welded wire mesh an expanded nickel, louvered nickel, punched nickel, or any other suitable structure that permits the free flow of electrolyte and evolved gas.

With respect to woven and welded wire meshes, a fine mesh mat according to the invention may have a wire diameter between 0.05 mm and 0.50 mm+/−10%. Other ranges within the scope of the invention include 0.05 and 0.10 mm, 0.10 and 0.15, 0.15 and 0.20, 0.20 and 0.25, 0.25 and 0.30, 0.30 and 0.35, 0.35 and 0.40, 0.40 and 0.45, 0.45 and 0.50 mm and any operable combination thereof. With further regard to woven and/or welded mats, the fine mesh may have a strand density between 1 strand per inch and 60 strands per inch+/−10%. Other strand density ranges within the scope of the invention include between 1 and 5, 5 and 10, 10 and 15, 15 and 20, 20 and 25, 25 and 30, 30 and 35, 35 and 40, 45 and 50, 50 and 55, 55 and 60 strands and any operable combination thereof.

According to embodiments of the invention a fine mesh may have a thickness between 0.05 and 0.50 mm+/−10%. Other ranges within the scope of the invention include 0.05 and 0.10 mm, 0.10 and 0.15, 0.15 and 0.20, 0.20 and 0.25, 0.25 and 0.30, 0.30 and 0.35, 0.35 and 0.40, 0.40 and 0.45, 0.45 and 0.50 mm and any operable combination thereof.

Catalytic coatings may be applied to cushion layers either in situ or ex situ. Ex situ methods include, without limitation, thermal or plasma spray, vacuum deposition, evaporative deposition, thermal curing/bonding, electroplating and other suitable methods. In situ application can utilize electroplating, electrophoresis or other techniques relying on the electrical current in the cell. Moreover, coatings may be applied either with or without roughening the substrate. It is contemplated that roughening according to known methods may increase electrolytically active surface area and thus result in improved performance. However, roughening is not a requirement or limitation of the invention.

Catalyst coatings according to the invention may have a thickness between 0.005 μm and 5 μm. Other thicknesses within the scope of the invention include 0.005 μm and 0.010, 0.010 and 0.015, 0.015 and 0020, 0.020 and 0.025, 0.025 and 0.030, 0.030 and 0.035, 0.035 and 0.040, 0.040 and 0.045, 0.045 and 0.050, 0.050 and 0.055, 0.055 and 0.060, 0.060 and 0.065, 0.065 and 0.070, 0.070 and 0.075, 0.075 and 0.080, 0.080 and 0.085, 0.085 and 0.090, 0.090 and 0.095, 0.095 and 0.100, 0.100 and 0.150, 0.150 and 0.200, 0.200 and 0.250, 0.250 and 0.300, 0.300 and 0.350, 0.350 and 0.400, 0.400 and 0.450, 0.450 and 0.500, 0.500 and 0.600, 0.600 and 0.700, 0.700 and 0.800, 0.800 and 0.900, 0.900 and 1.000, 1.000 and 1.500, 1.500 and 2.000, 2.000 and 2.500, 2.500 and 3.000, 3.000 and 3.500, 3.500 and 4.000, 4.000 and 4.500, 4.500 and 5.000 μm, and any operable combination thereof. Thicknesses may also exceed 5 μm.

Catalyst coatings according to the invention may have surface loadings between 5 mmol/$m^2$ and 120 mmol/$m^2$. Other ranges within the scope of the invention include 5 mmol/$m^2$ and 10, 10 and 15, 15 and 20, 20 and 25, 25 and 30, 30 and 35, 35 and 40, 40 and 45, 45 and 50, 50 and 55, 55 and 60, 60 and 65, 65 and 70, 7.0 and 75, 75 and 80, 80 and 85, 85 and 90, 90 and 95, 95 and 100, 100 and 105, 105 and 110, 110 and 115, 115 and 120, and any operable combination thereof.

Catalyst coatings of the invention may lower hydrogen overpotential of a zero-gap nickel cathode of a chlor-alkali membrane cell between 30 mV and 400 mV compared to the same cathode with no catalytic coating. Other ranges within the scope of the invention include 30 mV and 40 mV, 40 and 50, 50 and 60, 60 and 70, 70 and 80, 80 and 90, 90 and 100, 100 and 110, 110 and 120, 120 and 130, 130 and 140, 140 and 150, 150 and 160, 160 and 170, 170 and 180, 180 and 190, 190 and 200, 200 and 210, 210 and 220, 220 and 230, 230 and 240, 240 and 250, 250 and 260, 260 and 270, 270 and 280, 280 and 290, 290 and 300, 300 and 310, 310 and 320, 320 and 330, 330 and 340, 340 and 350, 350 and 360, 360 and 370, 370 and 380, 380 and 390, 390 and 400, and any operable combination thereof.

Catalyst coatings of the invention may lower hydrogen overpotential of a zero-gap nickel cathode of a chlor-alkali membrane cell between 20% and 50% compared to the same cathode with no catalytic coating. Other ranges within the scope of the invention include 20% and 25, 25 and 30, 30 and 35, 35 and 40, 45 and 50% and any operable combination thereof.

Catalyst compositions according to the invention may comprise of one or more of cobalt, copper, gold, iridium, osmium, palladium, rhenium, rhodium, ruthenium, or silver. These metals are referred to herein as catalytic metals, and as used herein they are said to be made from metal salt catalyst precursors. Additionally, catalyst compositions according to some embodiments of the invention may also contain one or more additive elements that aid or participate in the hydrogen evolution reaction such as, without limitation, copper, lanthanum, praseodymium, molybdenum, cerium, tantalum, titanium, molybdenum, manganese, tungsten, vanadium, indium, tin, nickel, chromium, zinc and carbon. According to embodiments of the invention, additive elements may be present in catalyst coatings, alone or in combination, in amounts not exceeding 50 at. %+/−10 at. %, and no less than 0.00001 at. %. Other ranges within the scope of the invention include, without limitation, 0.00001 at. % to 0.00010, 0.0001-0.0010, 0.001-0.010, 0.01-0.10, 0.1-1.0, 1.0-10.0, 10.0-20.0, 20.0-30.0, 30.0-40.0, and 40.0-50.0 at. %.

Suitable catalyst precursors and/or additive elements, in accordance with the invention, are soluble in the catholyte under typical in situ conditions, and/or either comprise a species or form a species in situ that is depositable on the cathode surface according to known methods such as, without limitation, electrophoresis or electroplating. As used herein, "in situ conditions" are those which are consistent with the ordinary operating conditions of the cell, such conditions being well-known to the person having ordinary skill in the art. In general, metal hydroxide and metal tetraamine complexes are expected to be particularly effective. In the special case of carbon as an additive element, the skilled artisan will appreciate that suitable forms in which carbon may be introduced include carbon dioxide, sodium or potassium carbonate, sodium or potassium bicarbonate, carbon monoxide, and/or methanol.

Cobalt metal salt catalyst precursors that are suitable for producing catalyst compositions of the present invention include, without limitation, tetramine (chloroaqua) cobalt (III), tetramine dichloro cobalt (III), and cobalt(II) hydroxide.

Gold metal salt catalyst precursors that are suitable for producing catalyst compositions of the present invention include, without limitation, gold(III) hydroxide and gold tetraamine complexes.

Iridium metal salt catalyst precursors that are suitable for producing catalyst compositions of the present invention include, without limitation, tetraamineiridium chloride, and iridium (IV) hydroxide.

Osmium metal salt catalyst precursors that are suitable for producing catalyst compositions of the present invention include, without limitation, tetraaminedioxoosmium (VI) chloride and osmium (IV) hydroxide.

Palladium metal salt catalyst precursors that are suitable for producing catalyst compositions of the present invention include, without limitation, palladium (II) hydroxide, and tetraamminepalladium (II) chloride monohydrate, tetraaminepalladium (II) hydroxide, tetraaminepalladium (II) tetrachloropalladate (II), tetraaminepalladium (II) oxalate and tetraaminepalladium (II) bromide.

Rhenium metal salt catalyst precursors that are suitable for producing catalyst compositions of the present invention include, without limitation, sodium perrhenate (VII) and potassium perrhenate (VII).

Rhodium metal salt catalyst precursors that are suitable for producing catalyst compositions of the present invention include, without limitation, rhodium (III) hydroxide, and tetraaminediaquarhodium (III) complexes.

Ruthenium metal salt catalyst precursors that are suitable for producing catalyst compositions of the present invention include, without limitation, ruthenium tetraamine and complexes, potassium ruthenate (VI), and sodium ruthenate (VI).

Silver metal salt catalyst precursors that are suitable for producing catalyst compositions of the present invention include, without limitation, silver(I) perrhenate, and silver(I) hydroxide.

Example 1

A Catalyzed Cushion Layer Significantly Lowers the Hydrogen Overpotential.

Electrolysis of 1N NaOH is conducted in a beaker utilizing a platinum mesh anode and a cathode comprised of fine nickel mesh, a nickel cushion layer, and coarse nickel mesh compressed together to form a cathode "sandwich". The fine nickel mesh is made from 0.127 mm diameter nickel 200 wire woven at 34 strands per inch. The cushion layer is made from nickel 200 wire with a diameter of 0.15 mm and containing 1.14 $m^2$ of actual surface area per $m^2$ of projected area. The coarse mesh is made from 0.625 mm thick nickel 200 expanded to have an actual surface area of 1.6 times that of the projected area. The gap between the anode and cathode is maintained at 19 mm and the electrolyte temperature is 85±5° C. Measurement of the cathode voltage is performed with a saturated calomel reference electrode and a lugin probe made from 1/16" diameter Teflon tubing inserted through the coarse and cushion layers and resting against the backside of the fine nickel mesh. The tubing is filled with 1N NaOH. No roughening or alteration of the nickel surfaces is performed, though it is expected that roughening would increase electrolytic activity. Voltages are recorded at a range of current densities which are calculated according to projected area.

A catalytic metal according to the invention was electroplated ex situ on none, some, or all of the cathode components prior to assembly of the cathode "sandwich". The following combinations were tested:

TABLE I

Figure 2:
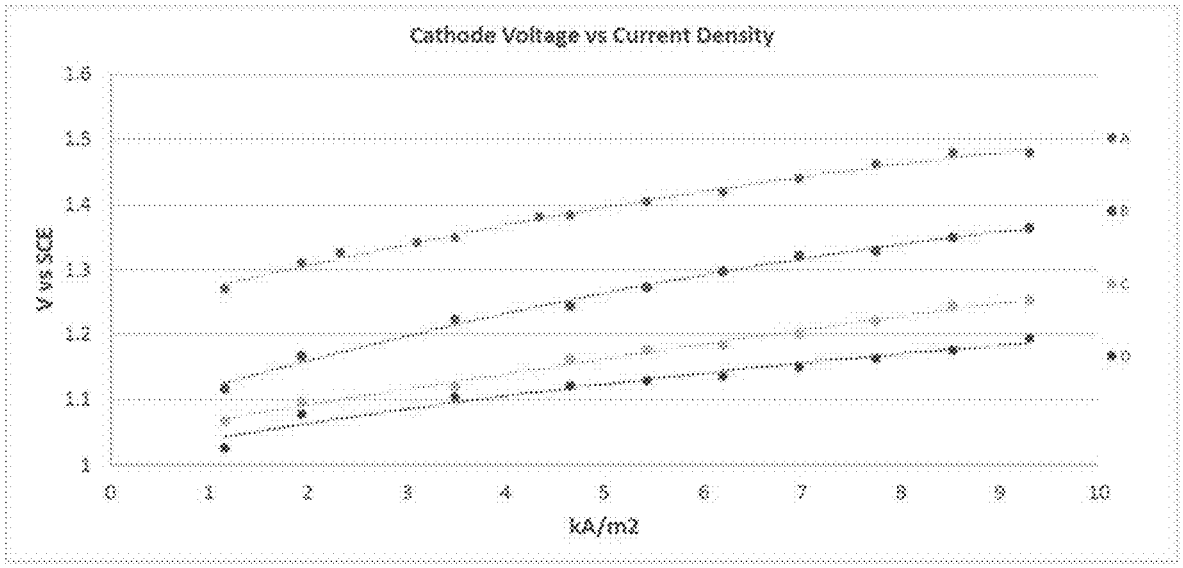
FIG. 2 is a graph showing that catalyzing the cushion layer has a significant effect on cell voltage.

Compare to FIG. 2.

| Trial | Coarse | Cushion | Fine |
|---|---|---|---|
| A | Bare Nickel | Bare Nickel | Bare Nickel |
| B | Bare Nickel | Bare Nickel | Catalyst |
| C | Catalyst | Bare Nickel | Catalyst |
| D | Catalyst | Catalyst | Catalyst |

Results are shown in FIG. 2 and illustrate that applying catalyst to the cushion layer significantly lowers the hydrogen evolution voltage, contrary to the result expected according to conventional wisdom. While not intending to be bound by theory, it is believed that the lower voltage is the result of more surface area evolving hydrogen which effectively lowers the current density and hence the voltage.

Example 2

Hydrogen Overpotential Drops in a Membrane Cell as Catalyst Deposition, i.e. Surface Coverage, Increases.

Electrolysis of 10N NaOH is conducted in a separated membrane cell utilizing an activated titanium mesh anode and a cathode comprised of fine nickel mesh, a nickel cushion layer, and coarse nickel mesh compressed together to form a cathode "sandwich". The fine nickel mesh is made from 0.127 mm diameter nickel 200 wire woven at 34 strands per inch. The cushion layer is made from nickel 200 wire with a diameter of 0.15 mm and containing 1.14 $m^2$ of actual surface area per $m^2$ of projected area. The coarse mesh is made from 0.625 mm thick nickel 200 expanded to have an actual surface area of 1.6 times that of the projected area. The cation selective membrane is Nafion® from the DuPont company. The anolyte is 1N NaOH, the catholyte is 10N NaOH and the cell temperature is 77±5° C. Measurement of the cathode voltage is performed with a saturated calomel reference electrode and a lugin probe made from 1/16" diameter Teflon tubing inserted through the coarse and cushion layers and resting against the backside of the fine nickel mesh. The tubing is filled with 1N NaOH. No roughening or alteration of the nickel surfaces is performed. Cathode voltages are recorded at a current density of 5.4 $kA/m^2$ and are calculated according to projected area.

Figure 3:
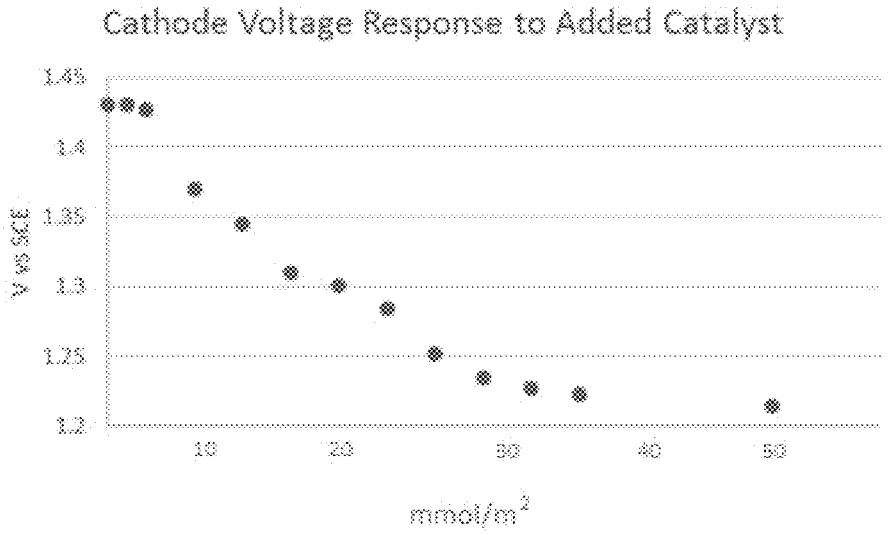
FIG. 3 is a graph showing voltage drop as a function of catalyst surface coverage.

During electrolysis and evolution of hydrogen from the cathode, known amounts of metal salt catalyst precursor are added to the catholyte for in situ deposition on the cathode. The addition of metal salt catalyst precursors catalyzes the cathode structure and lowers the voltage required for hydrogen evolution, i.e. the hydrogen overpotential. FIG. 3 shows how hydrogen overpotential decreases with increasing catalytic metal addition until a minimum voltage is achieved. This examples shows a drop of about 200 mV. The cathode sandwich is then dissected and the catalyst is observed on each layer of the cathode.

Example 3

Catalyst Lowers Hydrogen Overpotential at all Current Densities in a Membrane Cell.

Figure 4:
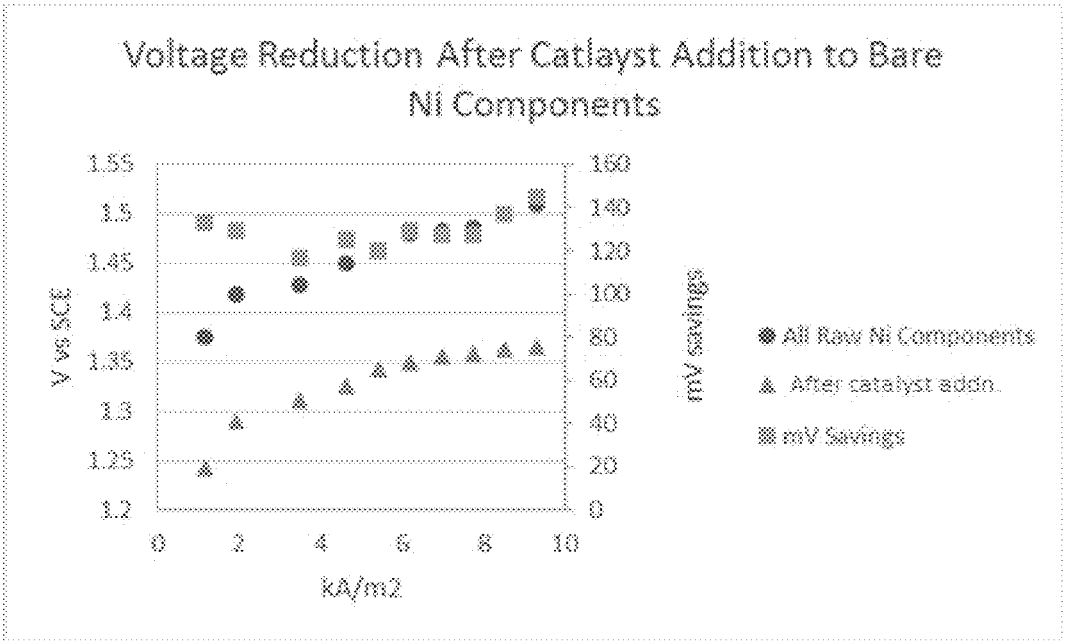
FIG. 4 is a graph showing the voltage savings as a function of current density in an in situ catalyzed zero-gap electrode versus the same electrode uncatalyzed.

The following process uses the same cell configuration as described in Example 2. Prior to addition of catalyst precursor, the voltage of a bare nickel cathode is measured against a saturated calomel reference electrode at a range of current densities. Following addition of 50 $mmol/m^2$ of catalyst precursor to the catholyte, according to projected area, the voltage of the cathode is again measured against a saturated calomel reference electrode at the same range of current densities. The temperature of the catholyte is 85±1° C. FIG. 4 shows that in situ catalyst addition lowers the voltage of the cathode across the entire range of current densities where measurements are taken. Following the experiment, the cathode is disassembled and catalyst deposition is observed on all layers of the cathode.

Example 4

Catalyst Lowers Hydrogen Overpotential at all Current Densities in an Undivided Cell.

Electrolysis of a solution of 1N NaOH with 44 mL per liter of 8% bleach solution is conducted in a beaker utilizing a platinum mesh anode and a cathode comprised of catalytic metal electroplated fine nickel mesh, a nickel cushion layer, and coarse nickel mesh compressed together to form a cathode "sandwich". The fine nickel mesh is made from 0.127 mm diameter nickel 200 wire woven at 34 strands per inch. The cushion layer is made from nickel 200 wire with a diameter of 0.15 mm and containing 1.14 $m^2$ of actual surface area per $m^2$ of projected area. The coarse mesh is made from 0.625 mm thick nickel 200 expanded to have an actual surface area of 1.6 times that of the projected area.

The gap between the anode and cathode is maintained at 19 mm and the electrolyte temperature is 85±5° C. Measurement of the cathode voltage is performed with a saturated calomel reference electrode and a lugin probe made from 1/16" diameter Teflon tubing inserted through the coarse and cushion layers and resting against the backside of the fine nickel mesh. The tubing is filled with 1N NaOH. No roughening or alteration of the nickel surfaces is performed aside from the deposition of catalyst on the fine nickel mesh.

Figure 5:
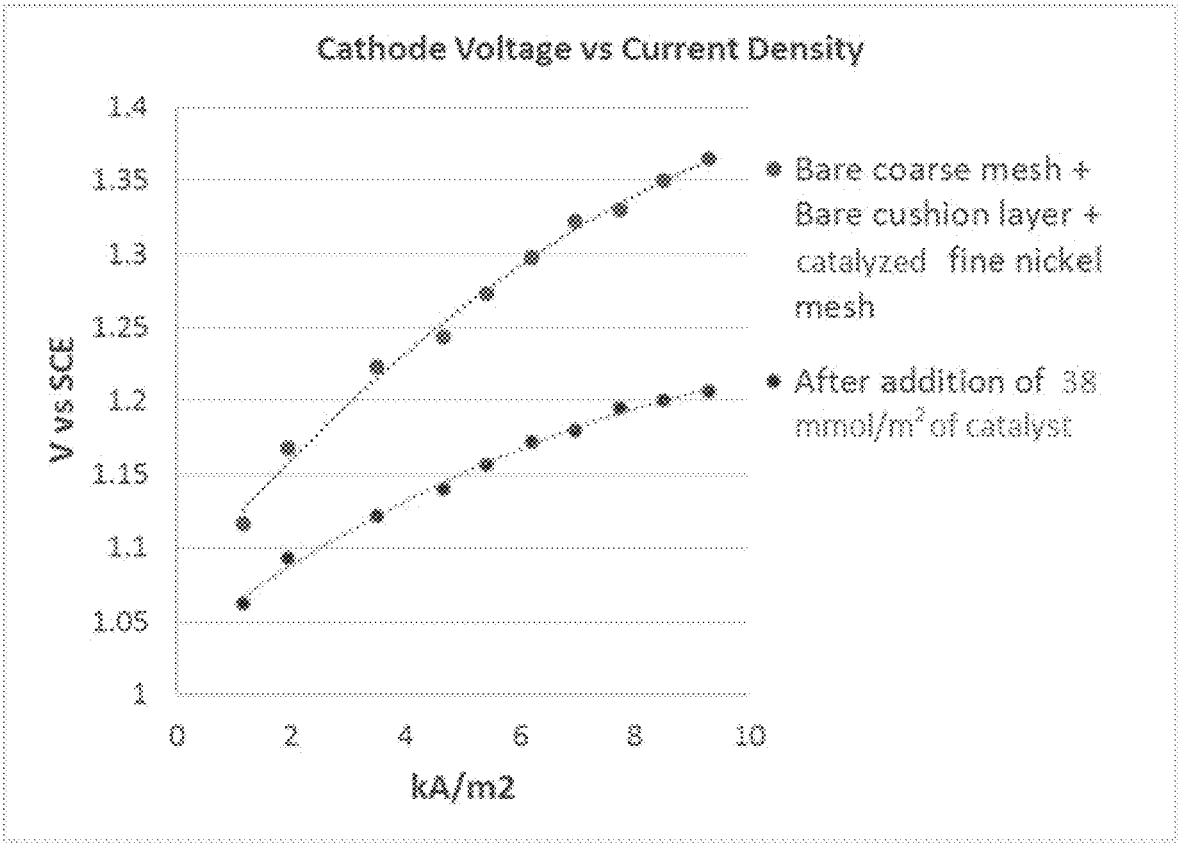
FIG. 5 is a graph showing the catalytic effect as a function of current density in a cell where only the fine mesh layer is catalyzed versus a cell where all cathode components are catalyzed.

Prior to adding catalyst, cathode voltages are recorded at a range of current densities calculated according to projected area. Catalyst is then plated in situ onto the cathode by adding 38 mmol/$m^2$ of catalyst precursor while operating the cell at 5.4 kA/$m^2$. Following the deposition of catalyst, the cathode voltage is again recorded at the same range of current densities. A plot of voltage versus current density is shown in FIG. 5 illustrating that the catalyst coating lowered the cathode voltage at all current densities, and that the voltage savings increases with current density.

It will be apparent to those skilled in the art that the above methods and apparatuses may be changed or modified without departing from the general scope of the invention. The invention is intended to include all such modifications and alterations insofar as they come within the scope of the appended claims or the equivalents thereof.

I claim:

1. A zero-gap electrode assembly, comprising:

a fine mesh being flexible and electrically conductive, the fine mesh having a catalytic coating consisting essentially of one or more of, iridium, osmium, palladium, rhenium, rhodium, or ruthenium;

a cushion layer in electrical communication with the fine mesh, the cushion layer having a catalytic coating consisting essentially of one or more of, iridium, osmium, palladium, rhenium, rhodium, or ruthenium; and a rigid backing, being electrically conductive and in electrical communication with the cushion layer.

2. The assembly of claim 1, wherein the flexible fine electrically conductive mesh comprises woven nickel wire mat having a wire diameter between 0.05 mm and 0.50 mm+/−10%, and a weave density between 20 strands per inch and 60 strands per inch+/−10%.

3. The assembly of claim 1, wherein the flexible fine electrically conductive mesh has a thickness between 0.05 mm and 0.50 mm+/−10%, and comprises woven nickel wire mat, welded nickel wire mat, expanded nickel, louvered nickel, or a punched porous nickel plate.

4. The assembly of claim 1, wherein the cushion layer has a catalytic coating between 0.005 μm and 5 μm thick.

5. The assembly of claim 1, wherein the cushion layer comprises a catalyst layer thickness greater than 5 μm.

6. The assembly of claim 1, wherein the cushion layer has a catalyst surface loading between 5 mmol/$m^2$ and 120 mmol/$m^2$.

7. The assembly of claim 1, wherein an interface between a cushion layer substrate and the catalytic coating of the cushion layer is substantially free from added roughness.

8. The assembly of claim 1, wherein the fine mesh is in electrically communicative physical contact with a cathode side of an ion-exchange membrane.

9. The assembly of claim 8, wherein the assembly is in electrochemical communication with a catholyte solution.

10. The assembly of claim 9, wherein the catholyte solution comprises caustic soda.

11. The assembly of claim 10, having a cathodic voltage that is 30 mV to 400 mV less than a voltage of the assembly without the catalyst layer.

12. The assembly of claim 10, having a cathodic voltage that is 20% to 50% less than a voltage of the assembly without the catalyst layer.

13. The assembly of claim 1, wherein the fine mesh is in electrically communicative physical contact with an anode side of an ion-exchange membrane.

14. The assembly of claim 13, wherein the assembly is in electrochemical communication with an anolyte solution.

15. The assembly of claim 1, wherein the rigid backing comprises a catalytic coating consisting essentially of one or more of, iridium, osmium, palladium, rhenium, rhodium, or ruthenium.

16. The electrode of claim 1, wherein the catalytic coating of the fine mesh and/or the cushion layer further comprises one or more additive elements selected from copper, lanthanum, praseodymium, molybdenum, cerium, tantalum, titanium, molybdenum, manganese, tungsten, vanadium, indium, tin, nickel, chromium, zinc and carbon.

17. The electrode of claim 16, wherein each of the one or more additive elements is present in an amount between 0.00001% and 50.0 at. %, wherein the sum of all additive elements does not exceed 50.0 at. %.

18. The electrode of claim 15, wherein the catalytic coating of the rigid backing further comprises one or more additive elements selected from copper, lanthanum, praseodymium, molybdenum, cerium, tantalum, titanium, molybdenum, manganese, tungsten, vanadium, indium, tin, nickel, chromium, zinc and carbon.

19. The electrode of claim 18, wherein each of the one or more additive elements is present in an amount between 0.00001% and 50.0 at. %, wherein the sum of all additive elements does not exceed 50.0 at. %.

* * * * *